US009858878B2

(12) United States Patent
Sone et al.

(10) Patent No.: US 9,858,878 B2
(45) Date of Patent: Jan. 2, 2018

(54) LIQUID CRYSTAL DISPLAY DEVICE

(71) Applicant: Sharp Kabushiki Kaisha, Osaka-shi, Osaka (JP)

(72) Inventors: Takuya Sone, Osaka (JP); Noriyuki Tanaka, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 22 days.

(21) Appl. No.: 14/786,198

(22) PCT Filed: Feb. 25, 2014

(86) PCT No.: PCT/JP2014/054551

§ 371 (c)(1),
(2) Date: Oct. 22, 2015

(87) PCT Pub. No.: WO2014/174887

PCT Pub. Date: Oct. 30, 2014

(65) Prior Publication Data

US 2016/0086559 A1 Mar. 24, 2016

(30) Foreign Application Priority Data

Apr. 23, 2013 (JP) ..... 2013-090710

(51) Int. Cl.
*G09G 3/36* (2006.01)
*G09G 3/20* (2006.01)
(Continued)

(52) U.S. Cl.
CPC ..... *G09G 3/3648* (2013.01); *G09G 3/2096* (2013.01); *G09G 3/3611* (2013.01);
(Continued)

(58) Field of Classification Search
CPC .. G09G 3/3611; G09G 3/3648; G09G 3/3677; G09G 3/2096; G09G 5/006;
(Continued)

(56) References Cited

U.S. PATENT DOCUMENTS

2002/0180673 A1 12/2002 Tsuda et al.
2011/0032231 A1* 2/2011 Maruyama ..... G09G 3/2096 345/208
(Continued)

FOREIGN PATENT DOCUMENTS

JP 2001-134244 A 5/2001
JP 2001134244 A * 5/2001
(Continued)

OTHER PUBLICATIONS

Official Communication issued in International Patent Application No. PCT/JP2014/054551, dated Jun. 3, 2014.

*Primary Examiner* — Amare Mengistu
*Assistant Examiner* — Jennifer Zubajlo
(74) *Attorney, Agent, or Firm* — Keating & Bennett, LLP

(57) ABSTRACT

A scanning line drive unit selects a plurality of scanning lines in order, and controls the operation of a thin-film transistors. A timing control unit controls the scanning line drive unit on the basis of a display signal that includes a horizontal synchronization signal, a vertical synchronization signal, and an image signal. The timing control unit is provided with: a first terminal to which the display signal is input; a second terminal to which a sub-synchronization signal, which is a signal other than the horizontal synchronization signal and the vertical synchronization signal, is input; and a notification unit that outputs a notification signal in a case where a period while only the sub-synchronization signal, among the horizontal synchronization signal, the vertical synchronization signal, and the sub-synchronization signal, is input is longer than a prescribed period.

7 Claims, 8 Drawing Sheets

(51) Int. Cl.

| | |
|---|---|
| ***G09G 5/00*** | (2006.01) |
| ***G09G 5/12*** | (2006.01) |
| *G09G 5/18* | (2006.01) |

(52) U.S. Cl.

CPC ..... *G09G 3/3677* (2013.01); *G09G 5/006* (2013.01); *G09G 5/12* (2013.01); *G09G 5/18* (2013.01); *G09G 2300/0426* (2013.01); *G09G 2310/08* (2013.01); *G09G 2330/021* (2013.01); *G09G 2330/04* (2013.01); *G09G 2330/08* (2013.01)

(58) Field of Classification Search

CPC .... G09G 5/12; G09G 5/18; G09G 2300/0426; G09G 2310/08; G09G 2330/021; G09G 2330/04; G09G 2330/08

See application file for complete search history.

(56) References Cited

U.S. PATENT DOCUMENTS

| | | | |
|---|---|---|---|
| 2011/0279431 | A1 | 11/2011 | Lee et al. |
| 2013/0222359 | A1 | 8/2013 | Nakata et al. |
| 2014/0035478 | A1 | 2/2014 | Kitakado et al. |

FOREIGN PATENT DOCUMENTS

| | | | | | |
|---|---|---|---|---|---|
| JP | 2001-312253 | A | | 11/2001 | |
| JP | 2007-093695 | A | | 4/2007 | |
| JP | 2007093695 | A | * | 4/2007 | |
| JP | 2007-286305 | A | | 11/2007 | |
| JP | 2011-242747 | A | | 12/2011 | |
| WO | 2012/057044 | A1 | | 5/2012 | |
| WO | WO 2012057044 | A1 | * | 5/2012 | ..... G09G 3/3614 |
| WO | 2012/117936 | A1 | | 9/2012 | |
| WO | WO 2012117936 | A1 | * | 9/2012 | ..... H01L 29/7869 |

* cited by examiner

LIQUID CRYSTAL DISPLAY DEVICE

TECHNICAL FIELD

The present invention relates to a liquid crystal display device.

BACKGROUND ART

A liquid crystal display device in which an image is displayed on a liquid crystal panel has been known conventionally. In the liquid crystal display device, images are displayed on the liquid crystal panel, based on display signals (including vertical synchronization signals, horizontal synchronization signals and image signals) sent from a host to a timing controller.

In recent years, in a liquid crystal display device, it is required to reduce electric power consumption. One of driving methods that reduce electric power consumption of a liquid crystal display device is a driving method called "pausing driving".

In the pausing driving, a driving period and a pausing period are alternately repeated. The driving period refers to, for example, a period in which a plurality of scanning lines are selected and scanned in order, and signal voltages are written. The pausing period refers to, for example, a period in which all of the scanning lines are caused to assume a non-selection state and the writing of signal voltages is suspended. In the pausing driving, since there is a period in which the writing of signal voltages is suspended, electric power consumption can be reduced. Such a pausing driving is disclosed in, for example, JP2001-312253A.

Disclosure of the Invention

The reduction of electric power consumption, however, could make it difficult to display appropriate images on the liquid crystal panel.

An exemplary configuration may be such that a host stops output of display signals to a timing controller appropriately as required so as to reduce electric power consumption. In this case, it is preferable that the timing controller determines whether the current period is a period while the host should stop output of display signals. This is because, in a case where no display signal is input to the timing controller though the current period is a period while the host should output display signals, it is difficult to display appropriate images.

An exemplary method for measuring the period is a method of using a vertical synchronization signal and/or a horizontal synchronization signal. The display signals sent from the host, however, include the vertical synchronization signal and the horizontal synchronization signal. When the output of display signals from the host is stopped, therefore, the input of the vertical synchronization signal and the horizontal synchronization signal to timing controller is stopped as well. Consequently, it becomes unable to determine whether the current period is a period while the output of a display signal from the host is carried out or not by using the vertical synchronization signal and/or the horizontal synchronization signal, it becomes difficult to display appropriate images.

To display appropriate images is similarly required in the case where the host does not stop the output of display signals to the timing controller appropriately as required.

An object of the present invention is to provide a liquid crystal display device capable of displaying appropriate images on a liquid crystal panel.

A liquid crystal display device according to an embodiment of the present invention includes a liquid crystal panel and displays an image on the liquid crystal panel. The liquid crystal panel includes a plurality of scanning lines, a plurality of signal lines, and thin film transistors. The plurality of signal lines intersect with the plurality of scanning lines. The thin film transistors are provided at points of intersection of the plurality of scanning lines and the plurality of signal lines, respectively, and are connected to pixel electrodes. The liquid crystal display device further includes: a scanning line drive unit; and a timing control unit. The scanning line drive unit selects the plurality of scanning lines in order and controls operations of the thin film transistors. The timing control unit controls the scanning line drive unit based on a display signal that includes a horizontal synchronization signal, a vertical synchronization signal, and an image signal. The timing control unit includes a first terminal, a second terminal, and a notification unit. To the first terminal, a display signal is input. To the second terminal, a sub-synchronization signal, which is a signal other than the horizontal synchronization signal and the vertical synchronization signal, is input. The notification unit outputs a notification signal in a case where a period while only the sub-synchronization signal, among the horizontal synchronization signal, the vertical synchronization signal, and the sub-synchronization signal, is input is longer than a predetermined period.

In the liquid crystal display device according to an embodiment of the present invention, appropriate images can be displayed on the liquid crystal panel.

EMBODIMENTS FOR CARRYING OUT THE INVENTION

Figure 1:
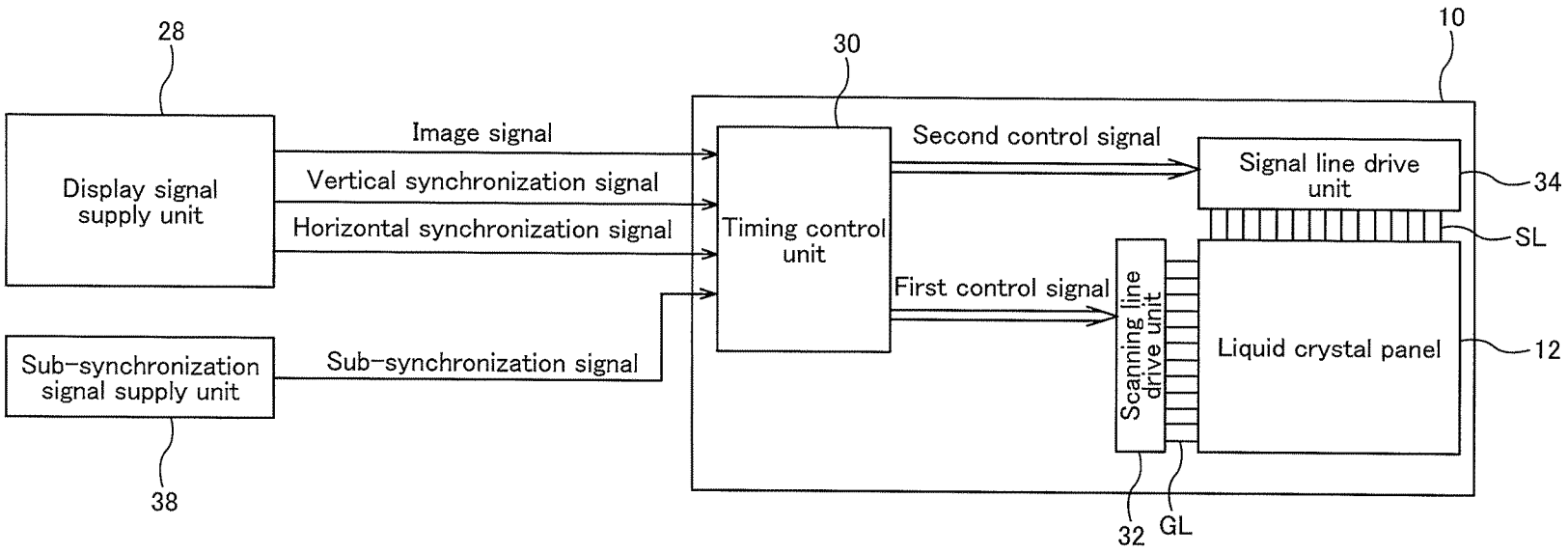
FIG. 1 is a block diagram illustrating a schematic configuration of a liquid crystal display device according to the First Embodiment of the present invention.

A liquid crystal display device according to a first aspect of the present invention includes a liquid crystal panel and displays an image on the liquid crystal panel. The liquid crystal panel includes a plurality of scanning lines, a plurality of signal lines, and thin film transistors. The plurality of signal lines intersect with the plurality of scanning lines. The thin film transistors are provided at points of intersection of the plurality of scanning lines and the plurality of signal lines, respectively, and are connected to pixel electrodes. The liquid crystal display device further includes a scanning line drive unit and a timing control unit. The scanning line drive unit selects the plurality of scanning lines in order and controls operations of the thin film transistors. The timing control unit controls the scanning line drive unit based on a display signal that includes a horizontal synchronization signal, a vertical synchronization signal, and an image signal. The timing control unit includes a first terminal, a second terminal, and a notification unit. To the first terminal, a display signal is input. To the second terminal, a sub-synchronization signal, which is a signal other than the horizontal synchronization signal and the vertical synchronization signal, is input. The notification unit outputs a notification signal in a case where a period while only the sub-synchronization signal, among the horizontal synchronization signal, the vertical synchronization signal, and the sub-synchronization signal, is input is longer than a predetermined period.

In the liquid crystal display device according to the first aspect, a notification signal is output in a case where a period while only the sub-synchronization signal, among the horizontal synchronization signal, the vertical synchronization signal, and the sub-synchronization signal, is input is longer than a predetermined period. Using this notification signal, a failure such that a display signal is not input to the timing control unit can be solved. In other words, in the liquid crystal display device according to the first aspect, appropriate images can be displayed on the liquid crystal panel.

A liquid crystal display device according to a second aspect of the present invention is the liquid crystal display device according to the first aspect configured so that the timing control unit alternately realizes a driving period and a pausing period. The driving period is a period while control of the scanning line drive unit based on the display signal is carried out. The pausing period is a period while control of the scanning line drive unit based on the display signal is suspended. The notification unit outputs the notification signal in the case where the period while only the sub-synchronization signal, among the horizontal synchronization signal, the vertical synchronization signal, and the sub-synchronization signal, is input is longer than the pausing period.

In the second aspect, the driving period and the pausing period are alternately realized. Therefore, electric power consumption can be reduced.

A liquid crystal display device according to a third aspect of the present invention is a liquid crystal display device according the second aspect configured so that the notification unit includes a counter. The counter increments a counter value every time when a sub-synchronization signal is input, and resets the counter value every time when the vertical synchronization signal is input.

A liquid crystal display device according to a fourth aspect of the present invention is the liquid crystal display device according to any one of the first to third aspects configured so that the display signal sent as a parallel signal is input to the timing control unit.

A liquid crystal display device according to a fifth aspect of the present invention is the liquid crystal display device according to the fourth aspect configured so as to further include an interface. The interface converts the display signal sent thereto as a differential serial signal into a parallel signal, and outputs the same to the timing control unit.

In the liquid crystal display device according to the fifth aspect, the display signal can be transferred at a high speed, as compared with the case where the display signal is sent as a parallel signal.

A liquid crystal display device according to a sixth aspect of the present invention is the liquid crystal display device according to any one of the first to fifth aspects configured so that the thin film transistor has a semiconductor layer made of an oxide semiconductor.

A liquid crystal display device according to a seventh aspect of the present invention is the liquid crystal display device according to the sixth aspect configured so that the oxide semiconductor contains indium (In), gallium (Ga), zinc (Zn) and oxygen (O).

In the liquid crystal display device according to the seventh aspect, leakage current can be reduced, as compared with the case where the semiconductor layer is made of silicon.

A liquid crystal display device according to an eighth aspect of the present invention is the liquid crystal display device according to the seventh aspect configured so that the oxide semiconductor has crystallinity.

The following describes more specific embodiments of the present invention while referring to the drawings. In the drawings, identical or equivalent parts are denoted by the same reference numerals, and descriptions of the same are not repeated.

The First Embodiment

FIG. 1 is a block diagram illustrating a liquid crystal display device 10 according to the First Embodiment of the present invention. The liquid crystal display device 10 is used for displaying images in, for example, a mobile device such as a smartphone and a tablet, a mobile phone, a television receiver, or a notebook computer. The liquid crystal display device 10 includes a liquid crystal panel 12, a timing control unit 30, a scanning line drive unit 32, and a signal line drive unit 34.

Figure 2:
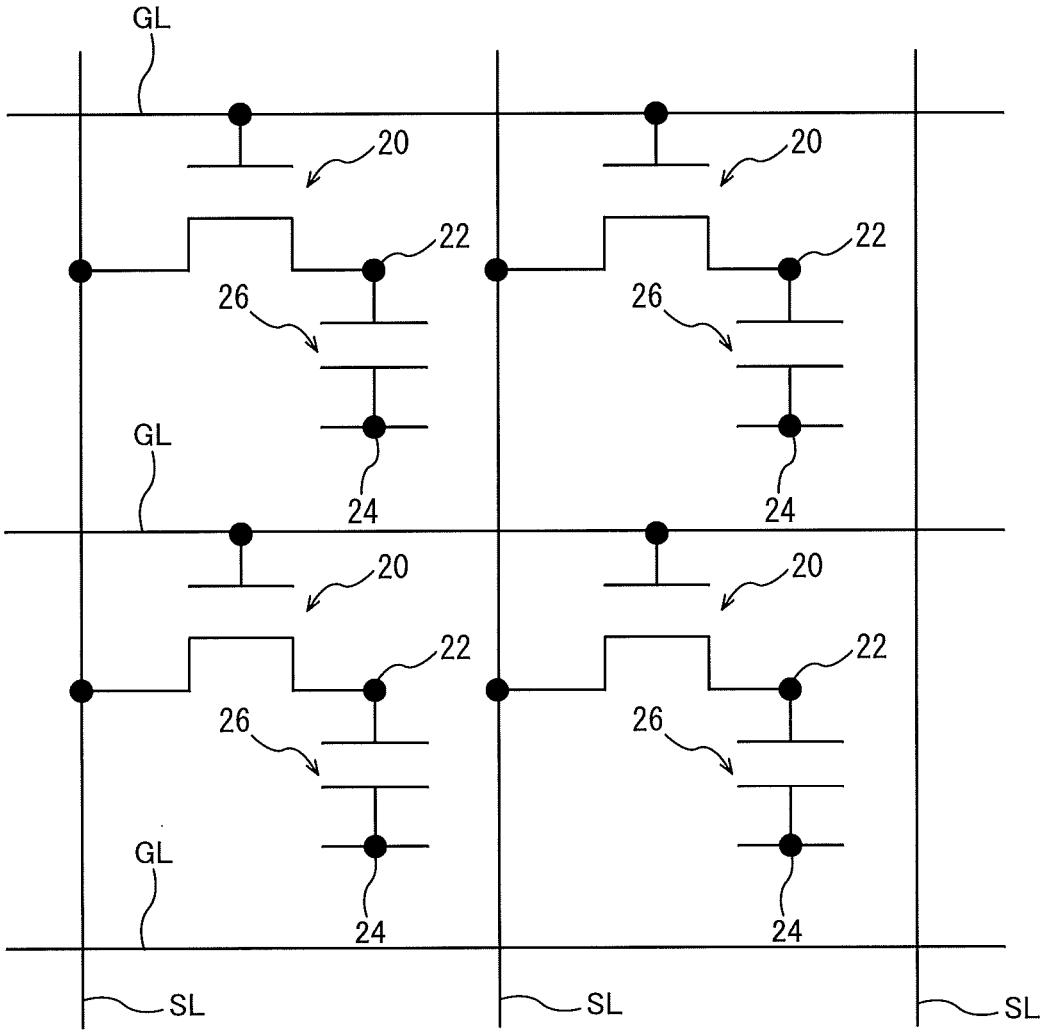
FIG. 2 is an equivalent circuit diagram for explaining pixels of a liquid crystal panel provided in the liquid crystal display device illustrated in FIG. 1.

The following describes the liquid crystal panel 12, while referring to FIG. 2. The liquid crystal panel 12 includes a plurality of scanning lines GL and a plurality of signal lines SL. The plurality of signal lines SL intersect with the plurality of scanning lines GL. A thin film transistor 20 as a switching element is provided at each of points of intersection of the scanning lines GL and the signal lines SL. Here, the phrase of "a thin film transistor 20 is provided at each of points of intersection of the scanning lines GL and the signal lines SL" also encompasses the case where a thin film transistor 20 is provided in the vicinities of a point of intersection of the scanning line GL and the signal line SL.

In the thin film transistor 20, a gate electrode is connected to the scanning line GL, a source electrode is connected to the signal line SL, and a drain electrode is connected to a pixel electrode 22. A common electrode 24 is provided so as to face the pixel electrode 22. Between the pixel electrode 22 and the common electrode 24, there is provided a liquid crystal layer. The pixel electrode 22, the common electrode 24, and the liquid crystal layer form an accumulation capacitor 26. Charges corresponding to a signal voltage written via the signal line SL and the thin film transistor 20 are accumulated in the accumulation capacitor 26, whereby a desired image is displayed on the liquid crystal panel 12.

The thin film transistor 20 may include a semiconductor layer made of silicon, but preferably includes a semiconductor layer made of an oxide semiconductor.

The oxide semiconductor contains, for example, an In—Ga—Zn—O-based semiconductor. Here, the In—Ga—Zn—O-based semiconductor is a ternary oxide of In (indium), Ga (gallium), and Zn (zinc), and the ratio (composition ratio) of In, Ga, and Zn is not limited particularly, and examples of the ratio include In:Ga:Zn=2:2:1, In:Ga:Zn=1:1:1, and In:Ga:Zn=1:1:2. In the present embodiment, the thin film transistor 20 includes an In—Ga—Zn—O-based semiconductor layer that contains In, Ga, and Zn at a ratio of 1:1:1.

Since the TFT including the In—Ga—Zn—O-based semiconductor layer has a high mobility (20 times or greater as compared with a-SiTFT) and a low leakage current (less than one hundredth as compared with a-SiTFT), such a TFT can be suitably used as a driving TFT and as a pixel TFT. Using the TFT having the In—Ga—Zn—O-based semiconductor layer makes it possible to significantly reduce electric power consumption of the liquid crystal display device 10.

The In—Ga—Zn—O-based semiconductor may be amorphous, or may include a crystalline-substance part thereby having crystallinity. As the crystalline In—Ga—Zn—O-based semiconductor, a crystalline In—Ga—Zn—O-based semiconductor having the c-axis aligned approximately in a perpendicular direction with respect to the layer surface is preferable. The crystal structure of such an In—Ga—Zn—O-based semiconductor is disclosed by, for example, JP2012-134475A. An entirety of contents disclosed in JP2012-134475A is incorporated herein for reference.

The oxide semiconductor may be an oxide semiconductor other than the In—Ga—Zn—O-based semiconductor. For example, the oxide semiconductor may be a Zn—O-based semiconductor (ZnO), an In—Z—O-based semiconductor (IZO (registered trademark)), a Zn—Ti—O-based semiconductor (ZTO), a Cd—Ge—O-based semiconductor, a Cd—Pb—O-based semiconductor, CdO (cadmium oxide), a Mg—Zn—O-based semiconductor, an In—Sn—Zn—O-based semiconductor (for example, $In_2O_3$—$SnO_2$—ZnO), or an In—Ga—Sn—O-based semiconductor.

Again, the following description is made with reference to FIG. 1. To the liquid crystal display device 10, a display signal is sent from the display signal supply unit 28. Here, the display signal includes a horizontal synchronization signal, a vertical synchronization signal, and an image signal. The display signal supply unit 28 outputs a display signal as a parallel signal to the timing control unit 30.

The timing control unit 30 generates a first control signal and a second control signal based on the display signal sent from the display signal supply unit 28. The first control signal includes a vertical synchronization signal. The second control signal includes a horizontal synchronization signal and an image signal. The timing control unit 30 outputs the first control signal and the second control signal to the scanning line drive unit 32 and the signal line drive unit 34, respectively.

The scanning line drive unit 32 is a gate driver. The scanning line drive unit 32 is connected to the plurality of scanning lines GL. The scanning line drive unit 32 selects and scans the plurality of scanning lines GL in order based on the first control signal sent from the timing control unit 30, so as to control operations of the thin film transistors 20.

The signal line drive unit 34 is a source driver. The signal line drive unit 34 is connected to the plurality of signal lines SL. The signal line drive unit 34 outputs a signal voltage to the plurality of signal lines SL based on the second control signal sent from the timing control unit 30.

To the liquid crystal display device 10, a sub-synchronization signal is sent from the sub-synchronization signal supply unit 38. Here, the sub-synchronization signal is a synchronization signal other than the horizontal synchronization signal and the vertical synchronization signal. The sub-synchronization signal supply unit 38 generates the sub-synchronization signal, and outputs the same to the timing control unit 30. In the present embodiment, the cycle of the sub-synchronization signal is identical to the cycle of the vertical synchronization signal.

Figure 3:
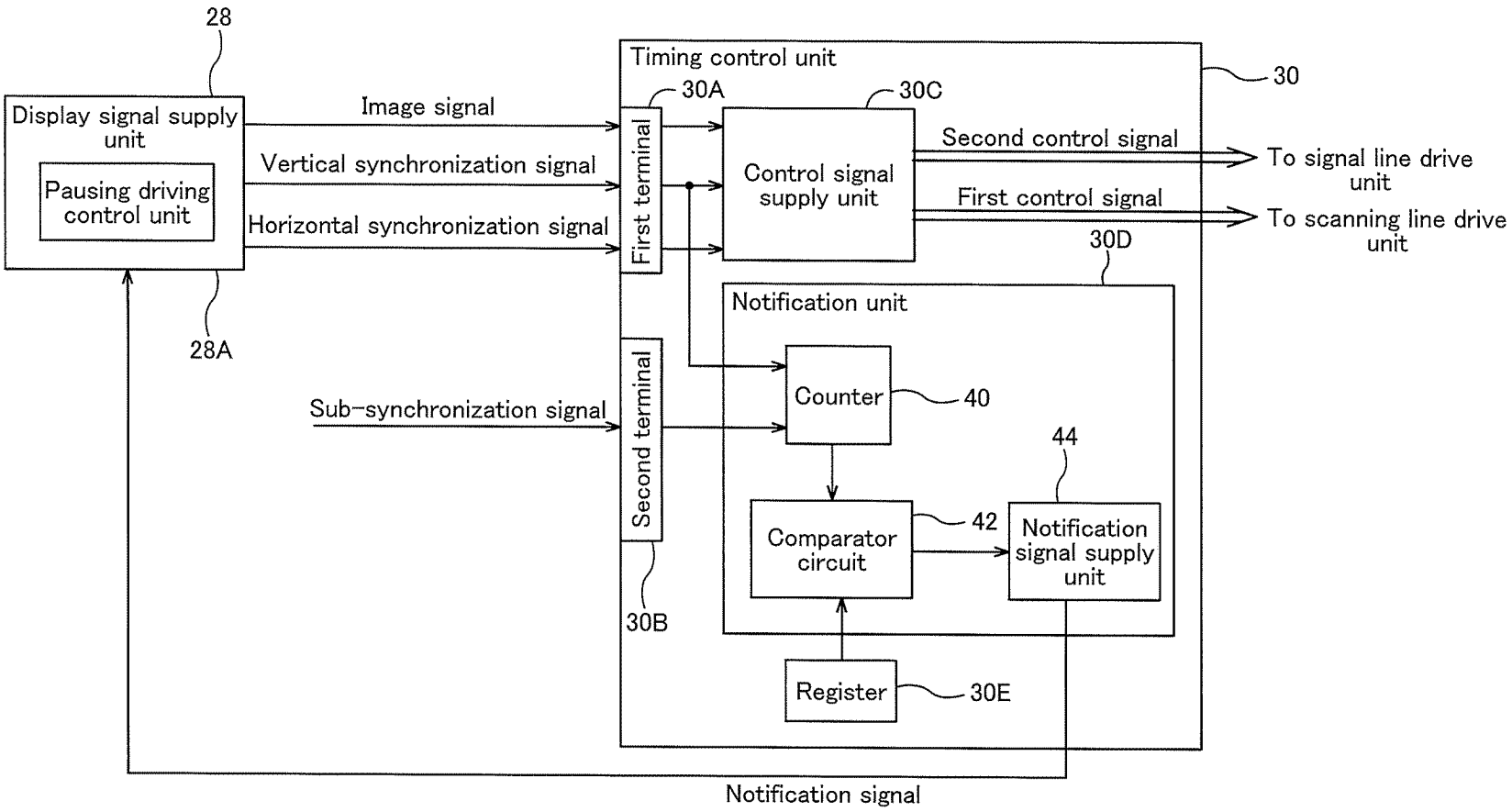
FIG. 3 is a block diagram for explaining a display signal supply unit and a timing control unit.

The following describes the display signal supply unit 28 and the timing control unit 30 while referring to FIG. 3. The display signal supply unit 28 includes a pausing driving control unit 28A.

The pausing driving control unit 28A controls output of a display signal to the timing control unit 30 by the display signal supply unit 28. More specifically, the pausing driving control unit 28A alternately realizes a period while the output of a display signal to the timing control unit 30 by the display signal supply unit 28 is carried out, and a period while the output of a display signal to the timing control unit 30 by the display signal supply unit 28 is suspended.

As mentioned above, based on the display signal sent from the display signal supply unit 28A, the timing control unit 30 generates the first control signal and the second control signal, and outputs the same. Then, based on the first control signal, the scanning line drive unit 32 selects and scans the plurality of scanning lines GL in order, so as to control the operations of the thin film transistors 20. Further, based on the second control signal, the signal line drive unit 34 outputs the signal voltage to each signal line SL. In other words, the timing control unit 30, a driving period in which control of the scanning line drive unit 32 based on the display signal is executed is realized, in the case where the display signal is input.

On the other hand, in a case where no display signal is sent from the display signal supply unit 28, the timing control unit 30 suspends generating the first control signal and the second control signal. Along with this, the timing control unit 30 suspends output of the first control signal to the scanning line drive unit 32 and output of the second control signal to the signal line drive unit 34. In other words, in the case where no display signal is input, the timing control unit 30 realizes a pausing period in which the control of the scanning line drive unit 32 based on the display signal is suspended.

Figure 4:
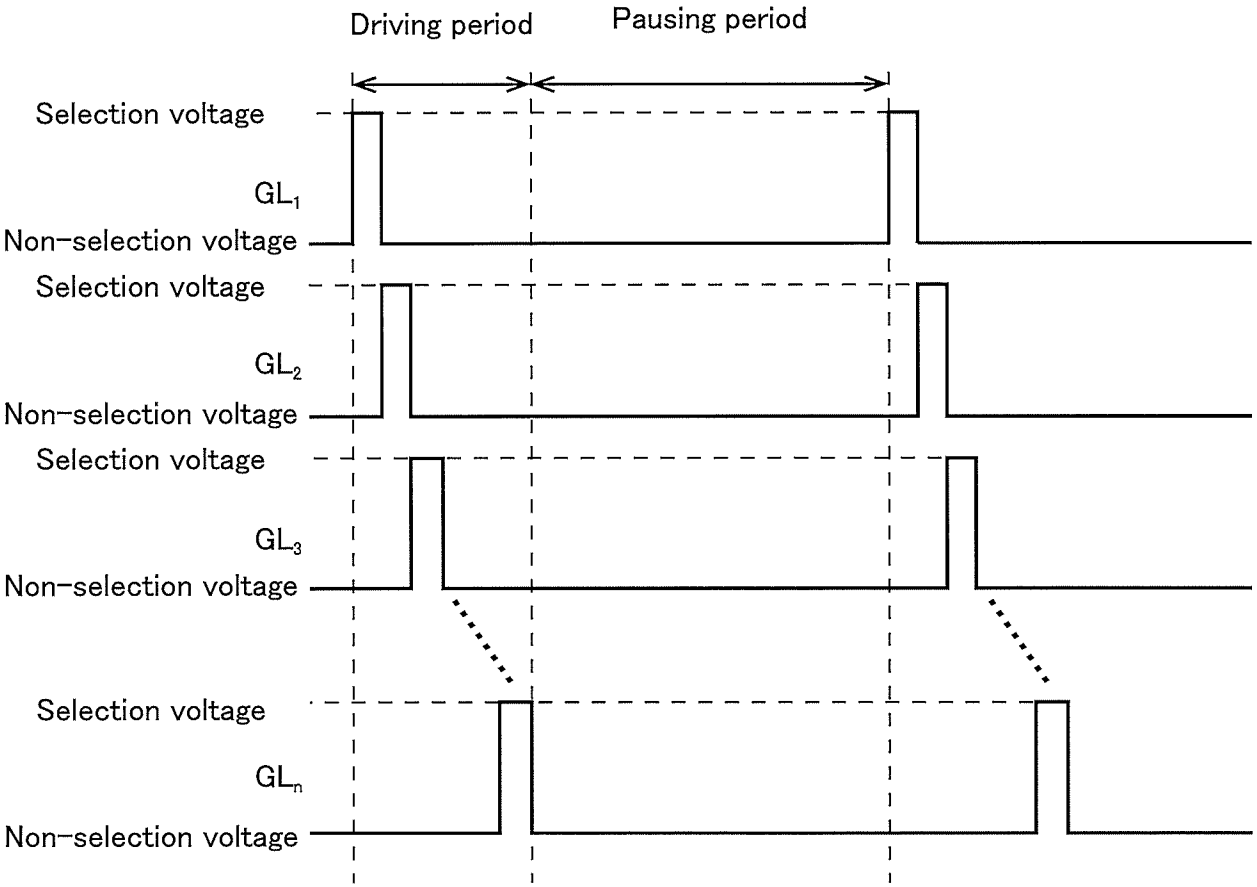
FIG. 4 is a time chart for explaining a driving period and a pausing period.

The following describes operations of the scanning line drive unit 32 during the driving period and the pausing period while referring to FIG. 4.

The scanning line drive unit 32 selects and scans the plurality of scanning line GL in order during the driving period. During the driving period, the scanning line drive unit 32 outputs a selection voltage to selected one of the scanning lines GL. During the driving period, the scanning line drive unit 32 outputs a non-selection voltage to non-selected ones of the scanning lines GL.

The scanning line drive unit 32 suspends selecting and scanning the plurality of scanning lines GL in order, during the pausing period. During the pausing period, the scanning line drive unit 32 outputs the non-selection voltage to all of the plurality of scanning lines GL.

Here, the non-selection voltage has a polarity other than that of the selection voltage. This reduces the leakage current when the thin film transistors 20 are turned off. Consequently, the display quality of the liquid crystal panel 12 can be ensured.

Figure 6:
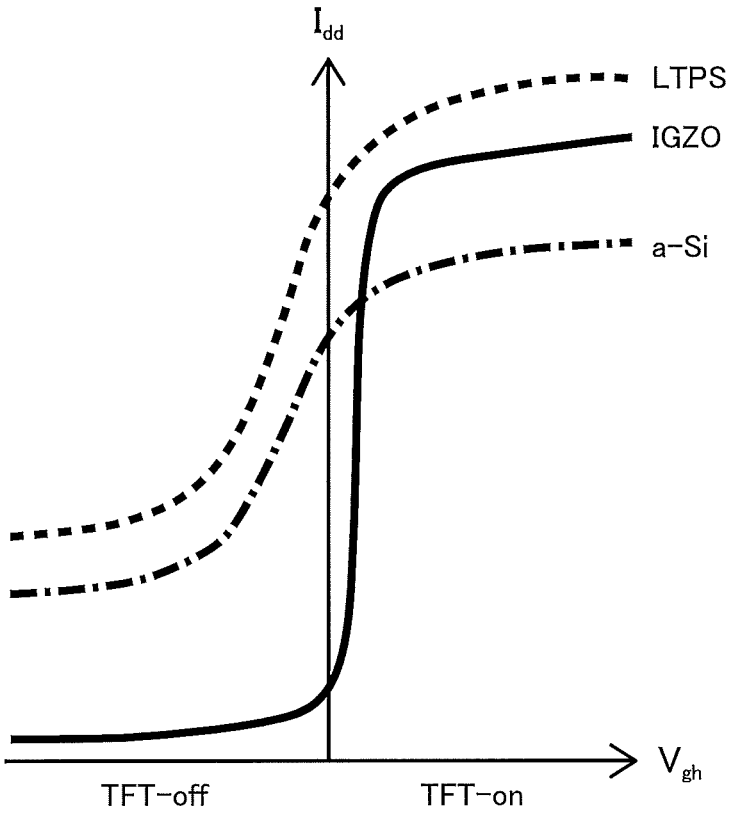
FIG. 6 is a graph showing operation properties of a thin film transistor.

In particular, in the present embodiment, the semiconductor layer of the thin film transistor 20 contains indium (In), gallium (Ga), zinc (Zn), and oxygen (O). As illustrated in FIG. 6, leakage current can be reduced, as compared with the case where the semiconductor layer is made of amorphous silicon, or the case where the semiconductor layer is made of low-temperature polysilicon.

The length of the pausing period may be equal to the length of the driving period, and preferably longer than the length of the driving period. In the case where the pausing period is longer than the driving period, electric power consumed by the display signal supply unit 28 can be reduced further. In the example illustrated in FIG. 4, the pausing period has a length twice the length of the driving period.

Again, the following description is made with reference to FIG. 3. The timing control unit 30 includes a first input terminal 30A, a second input terminal 30B, a control signal supply unit 30C, a notification unit 30D, and a register 30E.

To the first input terminal 30A, a display signal sent from the display signal supply unit 28 is input. To the second input terminal 30B, a sub-synchronization signal sent from the sub-synchronization signal supply unit 38 is input.

The control signal supply unit 30C generates a first control signal and a second control signal based on the display signal supplied from the display signal supply unit 28. The control signal supply unit 30C outputs the first control signal and the second control signal to the scanning line drive unit 32 and the signal line drive unit 34, respectively.

The notification unit 30D notifies the display signal supply unit 28 that a failure is occurring to the output of the display signal by the display signal supply unit 28. The notification unit 30D includes a counter 40, a comparator circuit 42, and a notification signal supply unit 44.

Figure 5:
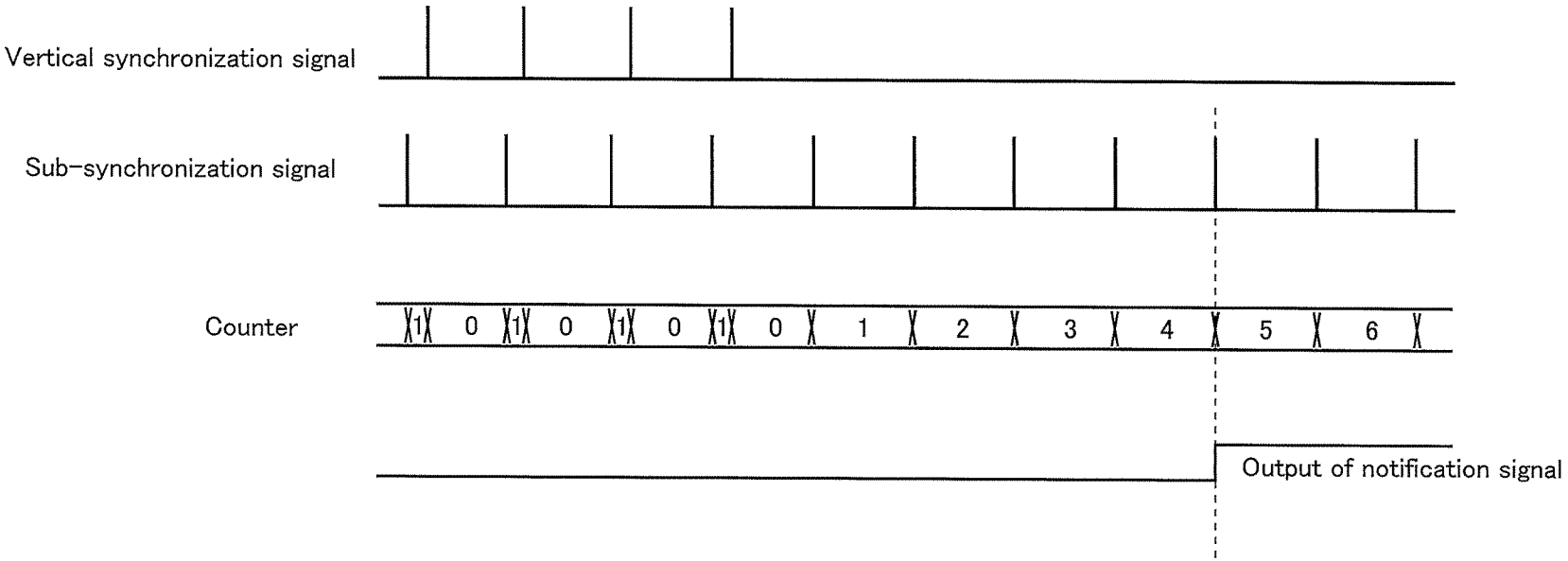
FIG. 5 is a time chart for explaining operations of a counter and a notification signal supply unit.

As illustrated in FIG. 5, the counter 40 increments a counter value thereof every time when a sub-synchronization signal is input, and resets the counter value every time when the vertical synchronization signal is input.

In the example illustrated in FIG. 5, the sub-synchronization signal has the same cycle as that of the vertical synchronization signal, but the input timings of these are different. The sub-synchronization signal, however, may be input at the same timing as that of the vertical synchronization signal.

The comparator circuit 42 reads out a reference counter value preliminarily stored in the register 30E, and compares the reference counter value and the counter value of the counter 40. The value is arbitrary, though the reference counter value is 5 in the example illustrated in FIG. 5.

The notification signal supply unit 44 outputs a notification signal to the display signal supply unit 28, in a case where the counter value is equal to or more than the reference counter value, as illustrated in FIG. 5. The notification signal indicates that a failure is occurring to the output of the display signal by the display signal supply unit, and more specifically, that the output of the display signal is not resumed in spite that the pausing period has ended.

The following describes image display by the liquid crystal display device 10.

First, a case is described where a display signal is sent from the display signal supply unit 28 to the timing control unit 30, that is, a case where the output of a display signal by the display signal supply unit 28 is being executed. In this case, the timing control unit 30 (the control signal supply unit 30C) generates the first control signal and the second control signal based on the display signal sent from the display signal supply unit 28. The timing control unit 30 outputs the first control signal and the second control signal to the scanning line drive unit 32 and the signal line drive unit 34, respectively.

The scanning line drive unit 32 selects and scans the plurality of scanning lines GL in order, based on the first control signal sent from the timing control unit 30, so as to control operations of the thin film transistors 20. The signal line drive unit 34 outputs a signal voltage to each signal line SL, based on the second control signal sent from the timing control unit 30. This allows charges corresponding to the signal voltage to be stored in the accumulation capacitor 26. Consequently, a desired image is displayed on the liquid crystal panel 12.

Next, a case is described where a display signal is not sent from the display signal supply unit 28 to the timing control unit 30, that is, a case where the output of a display signal by the display signal supply unit 28 is being suspended. In this case, the timing control unit 30 (the control signal supply unit 30C) suspends generating and outputting the first control signal and the second control signal. Therefore, the scanning line drive unit 32 suspends selecting and scanning the plurality of scanning lines GL in order. The signal line drive unit 34 suspends outputting the signal voltage to each signal line SL. Therefore, in the liquid crystal display device 10, electric power consumption can be reduced.

Further, in the liquid crystal display device 10, the sub-synchronization signal and the vertical synchronization signal are input to the counter 40. The counter 40 increments the counter value every time when the sub-synchronization signal is input. Further, the counter 40 resets the counter value every time when the vertical synchronization signal is input.

Here, when the output of the display signal by the display signal supply unit 28 is suspended, the vertical synchronization signal is not input to the counter 40, which causes the counter value to continuously increase.

When the counter value is equal to or more than the reference counter value, the notification signal supply unit 44 outputs the notification signal to the display signal supply unit 28. This signifies that, though the display signal should be sent from the display signal supply unit 28 to the timing control unit 30, the display signal is not sent thereto. In other words, this indicates that a failure is occurring to the output of the display signal by the display signal supply unit 28.

The display signal supply unit 28 restarts the display signal supply unit 28 when the notification signal is input thereto. This allows the output of the display signal by the display signal supply unit 28 to be returned to a normal state. Consequently, in the liquid crystal display device 10, appropriate image display can be achieved on the liquid crystal panel 12.

In the liquid crystal display device 10, the sub-synchronization signal has the same cycle as that of the vertical synchronization signal. Therefore, as compared with the case where the sub-synchronization signal has the same cycle as that of the horizontal synchronization signal, the increase of the counter value to a huge number can be prevented.

The Second Embodiment

Figure 7:
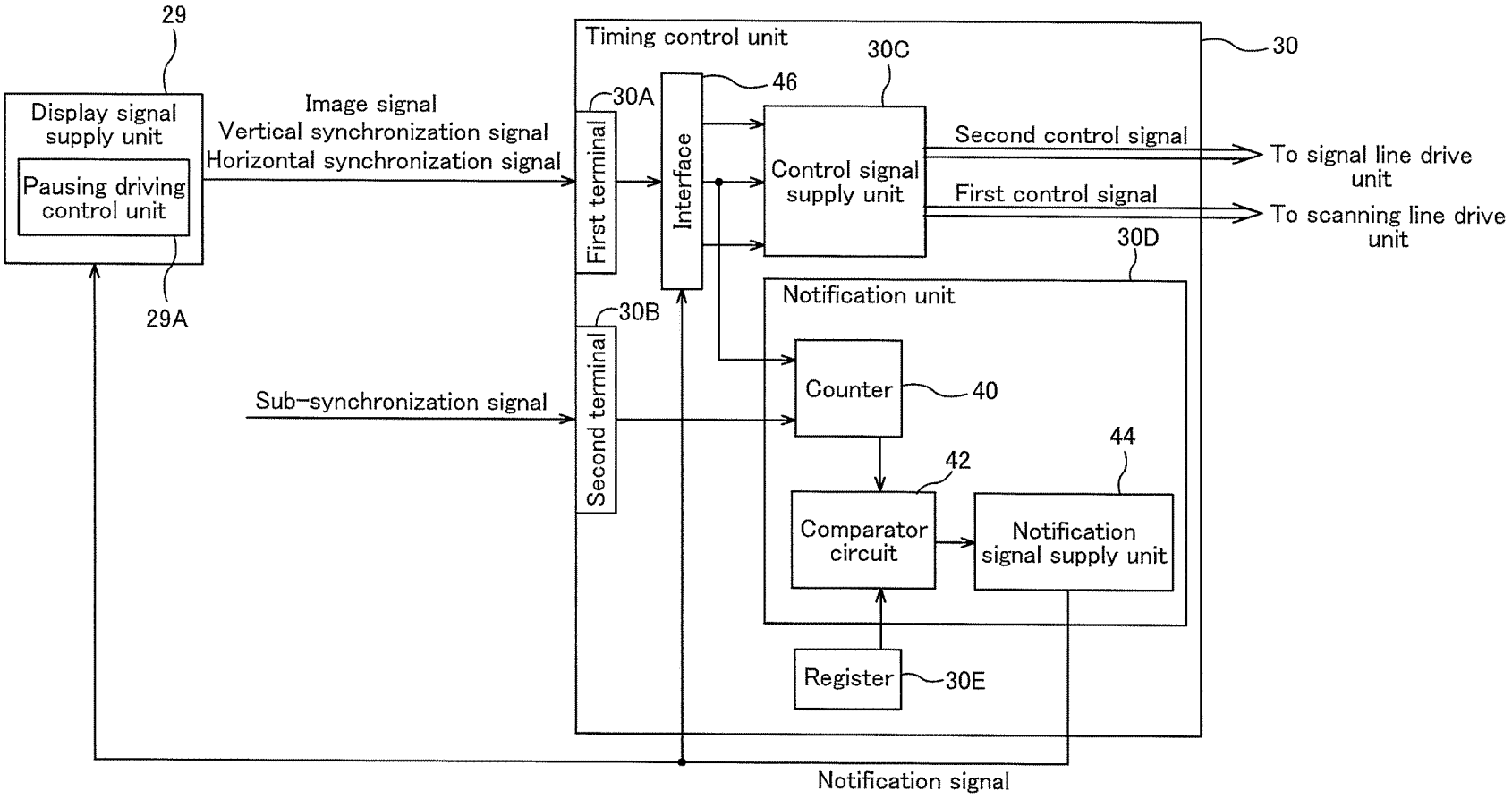
FIG. 7 is a block diagram for explaining a liquid crystal display device according to the Second Embodiment of the present invention.

The following describes a liquid crystal display device according to the Second Embodiment of the present invention while referring to FIG. 7. In the example illustrated in FIG. 7, a display signal supply unit 29 outputs a display signal as a differential serial signal. The display signal supply unit 29 includes a pausing driving control unit 29A.

The pausing driving control unit 29A controls output of the display signal to the timing control unit 30 by the display signal supply unit 29. More specifically, the pausing driving control unit 29A alternately realizes a period while the output of a display signal to the timing control unit 30 by the display signal supply unit 29 is carried out, and a period while the output of a display signal to the timing control unit 30 by the display signal supply unit 29 is suspended.

In the example illustrated in FIG. 7, the liquid crystal display device further includes an interface 46. The interface 46 converts a differential serial signal (display signal) sent from the display signal supply unit 29 into a parallel signal, and outputs the same to the timing control unit 30.

The notification signal supply unit 44 outputs a notification signal to each of the display signal supply unit 29 and the interface 46.

In the liquid crystal display device, the display signal supply unit 29 outputs the display signal as a differential serial signal. Therefore, as compared with the case where the display signal is output as a parallel signal, the display signal can be transferred at a high speed.

In the above-described liquid crystal display device, the notification signal is input to both of the display signal supply unit 29 and the interface 46. Therefore, even if a failure is occurring in either of the display signal supply unit 29 and the interface 46, a measure to address the failure can be taken.

The Third Embodiment

Figure 8:
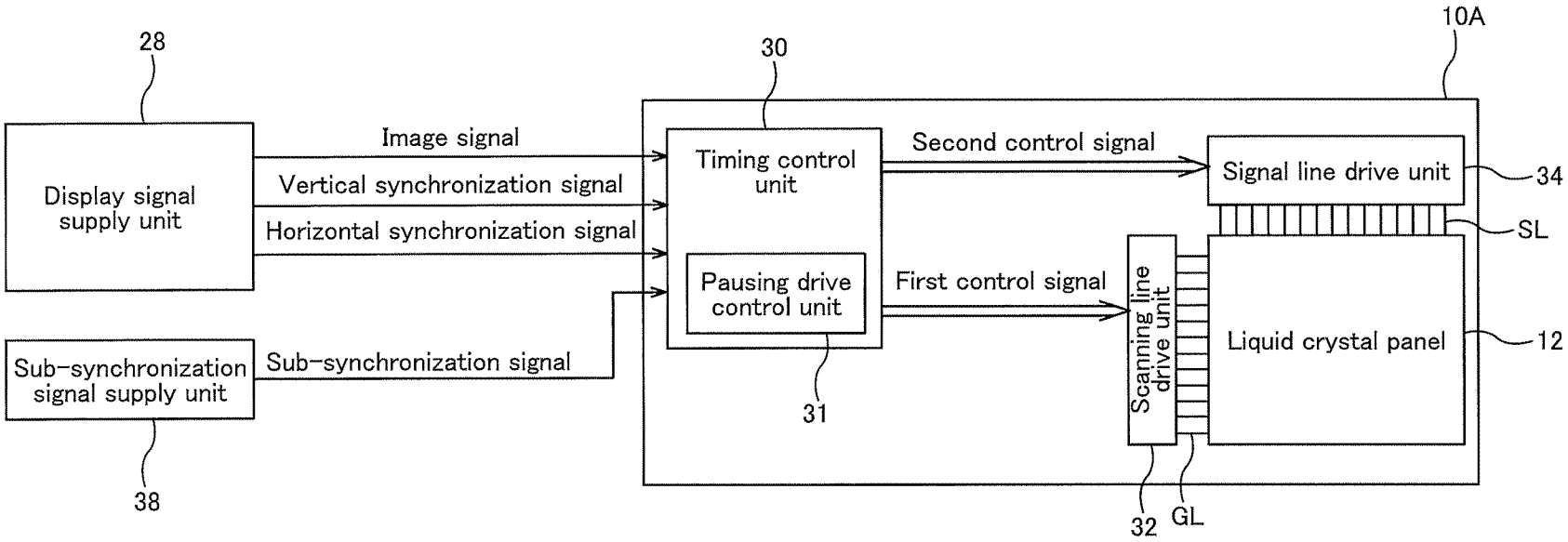
FIG. 8 is a block diagram for explaining a liquid crystal display device according to the Third Embodiment of the present invention.

The following describes a liquid crystal display device 10A according to the Third Embodiment of the present invention while referring to FIG. 8. In the liquid crystal display device 10A, as compared with the First Embodiment, the display signal supply unit 28 does not include the pausing driving control unit 28A, and instead, the timing control unit 30 includes the pausing driving control unit 31. The pausing driving control unit 31 alternately realizes a driving period while the control of the scanning line drive unit 32 and the signal line drive unit 34 based on the display signal is carried out, and a pausing period while the control of the scanning line drive unit 32 and signal line drive unit 34 based on the display signal is suspended. In other words, in the First Embodiment, the pausing period is realized when the timing control unit 30 does not receive a display signal, but in the present embodiment, the pausing period can be realized even if the timing control unit 30 receives a display signal. Even in this case, when the notification signal is input to the display signal supply unit 28, the output of the display signal by the display signal supply unit 28 can be returned to a normal state. Consequently, on the liquid crystal panel 12, appropriate images can be displayed.

The Fourth Embodiment

In the Second Embodiment, the display signal supply unit 29 does not have to include the pausing driving control unit 29A. Instead, the timing control unit 30 may include a pausing driving control unit, as is the case with the Third Embodiment. In other words, in the Second Embodiment, the pausing period is realized when the timing control unit 30 does not receive a display signal, but in the present embodiment, the pausing period can be realized even when the timing control unit 30 receives a display signal. Even in this case, when the notification signal is input to each of the display signal supply unit 29 and the interface 46, the output of the display signal by the display signal supply unit 29 and the output of the display signal by the interface 46 can be returned to respective normal states. Consequently, in liquid crystal panel 12, appropriate images can be displayed.

The Fifth Embodiment

In the First Embodiment, the display signal supply unit 28 does not have to include the pausing driving control unit 28A. Even in this case, when the notification signal is input to the display signal supply unit 28, the output of the display signal by the display signal supply unit 28 can be returned to a normal state. Consequently, on the liquid crystal panel 12, appropriate images can be displayed.

The Sixth Embodiment

In the Second Embodiment, the display signal supply unit 29 does not have to include the pausing driving control unit 29A. Even in this case, when the notification signal is input to each of the display signal supply unit 29 and the interface 46, the output of the display signal by the display signal supply unit 29 and the output of the display signal by the interface 46 can be returned to respective normal states. Consequently, on the liquid crystal panel 12, appropriate images can be displayed.

In the above description, the embodiments of the present invention are described in detail, but these are merely examples, and the present invention is not limited at all by the above-mentioned embodiments.

For example, in the First Embodiment, the sub-synchronization signal has the same cycle as that of the vertical synchronization signal, but may have a cycle different from that of the vertical synchronization signal.

The invention claimed is:

1. A liquid crystal display device comprising:

a liquid crystal panel that displays an image on the liquid crystal panel, wherein the liquid crystal panel includes:

a plurality of scanning lines;

a plurality of signal lines that cross the plurality of scanning lines; and thin film transistors provided at points where the plurality of scanning lines cross the plurality of signal lines, respectively, and are connected to pixel electrodes, the liquid crystal display device further comprises:

display signal supply circuitry;

sub-synchronization signal supply circuitry;

timing control circuitry; and scanning line drive circuitry that selects the plurality of scanning lines in order and controls operations of the thin film transistors;

the display signal supply circuitry provides the timing control circuitry with a display signal that includes a horizontal synchronization signal, a vertical synchronization signal, and an image signal, the sub-synchronization signal supply circuitry provides the timing control circuitry with a sub-synchronization signal, the sub-synchronization signal being a signal other than the horizontal synchronization signal and the vertical synchronization signal, the timing control circuitry controls the scanning line drive circuitry based on the display signal from the display signal supply circuitry, and the timing control circuitry includes:

a first terminal to which the display signal is input;

a second terminal to which the sub-synchronization signal is input; and notification circuitry that outputs a notification signal to the display signal supply circuitry in a case where a period, while only the sub-synchronization signal, among the horizontal synchronization signal, the vertical synchronization signal, and the sub-synchronization signal, is input, is longer than a predetermined period, the timing control circuitry alternately provides a driving period while controlling the scanning line drive circuitry based on the display signal is performed, and a pausing period while control of the scanning line drive circuitry based on the display signal is suspended, the notification circuitry outputs the notification signal in the case where the period, while only the sub-synchronization signal, among the horizontal synchronization signal, the vertical synchronization signal, and the sub-synchronization signal, is input, is longer than the pausing period, and the notification signal allows an output of the display signal by the display signal supply circuitry to be returned to a normal state.

2. The liquid crystal display device according to claim 1, wherein the notification circuitry includes a counter that increments a counter value every time when the sub-synchronization signal is input and that resets the counter value every time when the vertical synchronization signal is input.

3. The liquid crystal display device according to claim 1, wherein the display signal sent as a parallel signal is input to the timing control circuitry.

4. The liquid crystal display device according to claim 3, further comprising an interface that converts the display signal sent as a differential serial signal into a parallel signal and outputs the parallel signal to the timing control circuitry.

5. The liquid crystal display device according to claim 1, wherein the thin film transistor includes a semiconductor layer including an oxide semiconductor.

6. The liquid crystal display device according to claim 5, wherein the oxide semiconductor includes indium (In), gallium (Ga), zinc (Zn), and oxygen (O).

7. The liquid crystal display device according to claim 6, wherein the oxide semiconductor is crystalline.

* * * * *